US005419307A

United States Patent [19]

Linkletter et al.

[11] Patent Number: 5,419,307

[45] Date of Patent: May 30, 1995

[54] DRAFT HOOD ASSEMBLY

[76] Inventors: Dave Linkletter; Rob Mills, both of c/o Osburn Manufacturing Inc., 555 Ardersier Rd., Victoria, B.C., Canada, V8Z 1C8; Sam Greenberg, 5919 Wallace Drive, R.R. #5, Victoria, B.C., Canada, V8X 4M6; Brian Drescher, 1208 Altamont Ct., Victoria, B.C., Canada, V8Z 7G7; Norm Crane, Box 28, Steward Road, R.R. #2, Nanoose Bay, B.C., Canada, V0R 2R0; Phil Coby, 820 Roy Road, Victoria, B.C., Canada, V8Z 2X3; Rob Martin, c/o Osburn Manufacturing Inc., 555 Ardersier Rd, Victoria, B.C., Canada, V8Z 1C8

[21] Appl. No.: 150,604

[22] Filed: Nov. 10, 1993

[30] Foreign Application Priority Data

Mar. 4, 1993 [CA] Canada ..... 2091040

[51] Int. Cl.[6] ..... F23J 11/00

[52] U.S. Cl. ..... 126/307 R; 126/80; 126/312; 126/500

[58] Field of Search ..... 126/315, 316, 307 R, 126/307 A, 80, 500, 318, 312

[56] References Cited

U.S. PATENT DOCUMENTS

| | | | |
|---|---|---|---|
| 1,963,073 | 6/1934 | Butler | 126/307 A |
| 4,019,491 | 4/1977 | Di Rocco | 126/120 |
| 4,215,814 | 8/1980 | Ebert | 126/307 R |
| 4,270,894 | 6/1981 | Moore, Jr. et al. | 126/307 A |
| 5,263,470 | 11/1993 | Whitehouse | 126/500 |

FOREIGN PATENT DOCUMENTS

| | | |
|---|---|---|
| 256963 | 1/1926 | Canada . |
| 561176 | 8/1958 | Canada . |
| 1281249 | 8/1988 | Canada . |

*Primary Examiner*—James C. Yeung

*Attorney, Agent, or Firm*—Eckert Seamans Cherin & Mellott

[57] ABSTRACT

A draft hood assembly and method are provided for installation of a gas fireplace insert to the flue pipe of a fireplace chimney. The insert is for connection between a gas fireplace insert and a chimney flue pipe, the gas fireplace insert having an explicitly-described structure. The draft hood assembly includes a base plate, the base plate having an aperture therein, the aperture being alignable with the exhaust opening which is provided in the upper panel of exhaust channel of the fireplace insert. A hollow superstructure is integrally-mounted on the base plate, the superstructure body being of an explicitly-described structure, but further wherein an upper front plate terminates a spaced-distance above the base plate, and the bottom plate delineates an aperture alignable with the aperture in the base plate. The hollow superstructure body also includes a lower, rear exhaust chamber defined by an explicitly-described structure, which is in gaseous communication with the firebox. An upper, front exhaust chamber of an explicitly-described structure is in gaseous communication with the lower, rear exhaust chamber. An upper exhaust opening is provided in the top plate of the superstructure body, the upper exhaust opening leading from the upper, front exhaust chamber of the superstructure to the chimney flue pipe, the upper exhaust opening being situated forward of, and completely forwardly offset from, but being in gaseous communication with, the lower rear exhaust chamber. A longitudinally-curved deflector is secured to the lower forward plate, the longitudinally-curved deflector extending upwardly from the base plate and terminating a spaced-distance below the top panel of the superstructure body. Positioning bars are provided to enable securement of the draft hood assembly to the top panel of the firebox.

15 Claims, 3 Drawing Sheets

DRAFT HOOD ASSEMBLY

BACKGROUND OF THE INVENTION

(i) Field of the Invention

This invention relates to a gas fireplace insert and particularly to a novel draft hood assembly and method for connecting the exhaust of the fireplace insert to the fireplace chimney.

(ii) Description of the Prior Art

In the installation of a gas fireplace insert, a flue liner or duct must be provided from the firebox to conduct the exhaust from the firebox of the insert to the chimney of the fireplace. Commonly, an exhaust opening is formed at the top panel of the firebox of the fireplace insert which is located below the chimney opening when the fireplace insert is fully inset into the fireplace. A flue liner or duct is commonly installed on the exhaust opening of the firebox of the fireplace insert and is pushed upwards into the fireplace chimney to ensure that the exhaust gas is directed entirely up into the chimney so that no exhaust gas can leak into the space between the firebox of the fireplace insert and the fireplace. Such leakage of exhaust gas would return to the room noxious components which would present a human health hazard.

It has been found that there are problems in the installation of the flue liner to the firebox of the fireplace insert. It is known that there is extremely little space between the firebox of the fireplace insert and the fireplace walls once the firebox of the fireplace insert is inset into the fireplace. Thus, it is extremely difficult to manoeuvre the flue liner into the chimney or to connect it properly to the exhaust opening of the firebox of the fireplace insert.

Carefully designed draft hoods are designed to be installable on gas fireplaces which are inserts into masonry fireplaces and which have lintels or top openings that are not much taller than the fireplace insert. In the past this necessitated making the connection of the draft hood to the gas fireplace insert as the insert is being pushed back into the opening.

Another problem, moreover, is to provide a structure that would prevent backdrafts from discharging noxious fumes and other debris into the fireplace insert and consequently into a room. These problems have been addressed by previous patentees.

Canadian Patent No. 256,963 patented Jan. 5, 1926 by G. A. Richey, provided a device adapted to be installed in either new or old fireplaces for the prevention of the escape of soot into the room and for the regulation of the up-draft and thereby to prevent backdrafts. The patented device was a specially constructed throat member and a false rear wall together with a pair of associated dampers pivotally hinged or mounted within or upon the discharge pipe or elbow connected with the converging upper end of the throat member. Thus, in essence, that patentee provided a fireplace or hearth having a smoke chamber, a throat member within the chamber, a damper within the throat member, a vertical division wall extending downwardly from the rear edge of the throat member and spaced-apart from the main rear wall of the fireplace, and an inclined strip forming a converging soot collecting compartment behind the wall.

Canadian Patent No. 561,176 patented Aug. 5, 1958 by J. A. Manchester et al, provided a solution to such problem in a fireplace insert or stove including an inner housing formed of sheet steel having a bottom hearth plate, a back plate, an upper plate and two end plates secured together forming a firebox. An outer housing which was formed of sheet steel had a bottom plate, a back plate and two end plates secured together to enclose the inner housing with the respective bottom and end plates spaced apart forming a plenum chamber outside of the firebox. The front plate had a first U-shaped section extending between and securing together in pairs, the front edges of the bottom and end plates. A second section of the front plate depended from the front edge of the upper plate and terminated in a lower flange inturned into the firebox. The upper plate had a curved opening in its rear central portion and a smoke stack, curved in cross-section, was secured in the opening. A smoke shelf plate extended between, and was secured to, the end plates and back plate of the inner housing and extended forward over half way to the front of the firebox and rose from the back plate to its forward edge. A baffle plate having a substantially-horizontal portion extended between the end plates of the inner housing and was positioned a short distance below the upper plate and a short distance above the forward edge of the smoke shelf plate. The baffle plate extended from a point spaced a short distance from the inturned lower flange to a point more than half way to the rear of the firebox. The baffle plate also had a flange portion extending downwardly and inwardly from its forward edge. The outer housing had upper and lower openings therein permitting air from outside of the stove to circulate around the firebox.

Canadian Patent No. 1,281,249 patented Mar. 12, 1991 by H. H. Rieger, provided an alleged solution to this problem by the provision of a flue liner adapter for use in a firebox suitable for installation in a fireplace having a chimney, the firebox having an exhaust opening formed in a top panel therein. The flue liner adaptor included at least two slider brackets operative for mounting on the top panel of the firebox. A plate was operative slidably engageable with the slider bracket mounted on the firebox, the plate having a coupling opening formed therein. A sleeve was located over the coupling opening and extended upwardly from the plate, and was operative for connection with a flue liner inserted into the chimney.

U.S. Pat. No. 4,019,491 patented Apr. 26, 1977 by N. DiRocco provided a no draft chimney throat. The patentee provided a damper and throat attached to the sides of the chimney hood portion immediately above the firebox. This construction provided a chamber into which downdrafts from the chimney will be directed so as to be diverted back up the chimney. In addition that chamber provided a region where the draft from the firebox or combustion chamber together with smoke will be diverted up the chimney. Accordingly, such draft, if diverted otherwise by the downdraft, will also enter an air shelf and be returned up the chimney.

SUMMARY OF THE INVENTION

(i) Aims of the Invention

In spite of these patented proposals there still is a need for an adaptor for the fireplace insert.

One object of this invention is the provision of such an adaptor which provides for the connection of the exhaust from the firebox of the fireplace insert to the chimney while simultaneously substantially preventing any back draft from discharging noxious fumes into the room.

Another object of this invention is to provide a gas fireplace insert combined with such an adaptor for connection to the chimney.

(ii) Statement of Invention

This invention now provides a draft hood assembly for connection between a gas fireplace insert and a chimney flue pipe, the gas fireplace insert consisting of a hollow, rectangular, parallelepiped firebox consisting of six mutually-perpendicularly-interconnected panels, the panels comprising a top panel, a front panel, a rear panel, a bottom panel and a pair of side panels, and the top panel including an exhaust vent opening therein, an exhaust channel superposed on the top panel, the exhaust channel being bounded by the top panel, the upper panel and front and rear members, the upper panel including an exhaust opening therein and a transversely-extending, rear edge. The draft hood assembly comprises: a base plate, the base plate having an aperture therein, the aperture being alignable with the exhaust opening which is provided in the upper panel of the exhaust channel of the fireplace insert; a hollow superstructure body integrally-mounted on the base plate, the superstructure body comprising a rear plate, a pair of side plates perpendicularly-connected thereto, a lower front plate perpendicularly-connected to each of the side plates, a bottom plate perpendicularly-connected to the lower front plate, to the side plates and to the rear plate, the bottom plate delineating an aperture alignable with the aperture in the base plate, an upper front plate perpendicularly-connected to the side plates, the upper front plate terminating a spaced-distance above the base plate, and a top plate perpendicularly-connected to the rear plate, to the side plates and to the upper front plate, the hollow superstructure body also including a lower, rear, exhaust chamber defined by the rear plate, the side plates and the lower front plate, the lower, rear exhaust chamber thereby being in gaseous communication with the firebox, and an upper, front exhaust chamber which is in gaseous communication with the lower, rear exhaust chamber, the upper, front exhaust chamber being defined by the top plate, the side plates, the upper, front wall and an open bottom face; an upper exhaust opening in the top plate of the superstructure body, the upper exhaust opening leading from the upper, front exhaust chamber of the superstructure to the chimney flue pipe, the upper exhaust opening being situated forward of, but being completely forwardly offset from, and also being in gaseous communication with, the lower rear exhaust chamber; a longitudinally-curved deflector secured to the lower front plate, the longitudinally-curved deflector extending upwardly from the base plate and terminating a spaced-distance below the top panel of the superstructure body; and positioning bars to enable securement of the draft hood assembly to the top panel of the firebox.

This invention also provides the combination of (A) a gas fireplace insert consisting of a hollow rectangular parallelepiped firebox consisting of six mutually-perpendicularly-interconnected panels, the panels comprising a top panel, a front panel, a rear panel, a bottom panel and a pair of side panels, and the top panel including an exhaust vent opening therein, an exhaust channel superposed on the top panel, the exhaust channel being bounded by the top panel, the upper panel and front and rear members, the upper panel including an exhaust opening therein and a transversely-extending, rear edge and having a forward positioning clip and a pair of lateral positioning clips thereon; and (B) a draft hood assembly comprising: a base plate, the base plate having an aperture therein, the aperture being alignable with the exhaust opening which is provided in the upper panel of exhaust channel of the fireplace insert; a hollow superstructure body integrally-mounted on the base plate, the superstructure body comprising a rear plate, a pair of side plates perpendicularly- connected thereto, a lower front plate perpendicularly-connected to each of the side plates, a bottom plate perpendicularly-connected to the lower front plate, to the side plates and to the rear plate, the bottom plate delineating an aperture alignable with the aperture in the base plate, an upper front plate perpendicularly-connected to the side plates, the upper front plate terminating a spaced-distance above the bas plate, and a top plate perpendicularly-connected to the rear plate, to the side plates and to the upper front plate, the hollow superstructure body also including a lower, rear exhaust chamber defined by the rear plate, the side plates and the lower front plate, the lower, rear exhaust chamber thereby being in gaseous communication with the firebox, and an upper, front exhaust chamber which is in gaseous communication with the lower, rear exhaust chamber, the upper, front exhaust chamber being defined by the top plate, the side plates, the upper front wall and an open bottom face; an upper exhaust opening in the top plate of the superstructure body, the upper exhaust opening leading from the upper, front exhaust chamber of the superstructure to the chimney flue pipe, the upper exhaust opening being situated forward of, but being completely forwardly offset from, and also being in gaseous communication with, the lower rear exhaust chamber; a longitudinally-curved deflector secured to the lower front plate, the longitudinally-curved deflector extending upwardly from the base plate and terminating a spaced-distance below the top panel of the superstructure body; and positioning bars to enable securement of the draft hood assembly to the top panel of the firebox.

This invention still further provides a method for installing a gas fireplace insert into a fireplace which method comprises: providing a draft hood assembly as described above; securing the fireplace insert consisting of a hollow, rectangular, parallelepiped firebox consisting of six mutually-perpendicularly-interconnected panels, the panels comprising a top panel, a front panel, a rear panel, a bottom panel and a pair of side panels, and the top panel including an exhaust vent opening therein, an exhaust channel superposed on the top panel, the exhaust channel being bounded by the top panel, the upper panel and front and rear members, the upper panel including an exhaust opening therein and a transversely-extending, rear edge and having a forward positioning clip and a pair of lateral positioning clips thereon. The draft hood assembly comprises: a base plate, the base plate having an aperture therein, the aperture being alignable with the exhaust opening which is provided in the upper panel of the exhaust channel of the fireplace insert; a hollow superstructure body integrally-mounted on the base plate, the superstructure body comprising a rear plate, a pair of side plates perpendicularly-connected thereto, a lower front plate perpendicularly-connected to each of the side plates, a bottom plate perpendicularly-connected to the lower front plate, to the side plates and to the rear plate, the bottom plate delineating an aperture alignable with the aperture in the base plate, an upper front plate perpendicularly-connected to the side plates, the upper front plate terminating a spaced-distance above the base plate, and a top plate perpendicularly-connected to the rear plate, to the side plates and to the upper front plate, the hollow superstructure body also including a lower, rear, exhaust chamber defined by the rear plate, the side plates and the lower front plate, the lower, rear exhaust chamber thereby being in gaseous communication with the firebox, and an upper, front exhaust chamber which is in gaseous communication with the lower, rear exhaust chamber, the upper, front exhaust chamber being defined by the top plate, the side plates, the upper, front wall and an open bottom face; an upper exhaust opening in the top plate of he superstructure body, the upper exhaust opening leading from the upper, front exhaust chamber of the superstructure to the chimney flue pipe, the upper exhaust opening being situated forward of, but being completely forwardly offset from, and also being in gaseous communication with, the lower rear exhaust chamber; a longitudinally-curved deflector secured to the lower front plate, the longitudinally-curved deflector extending upwardly from the base plate and terminating a spaced-distance below the top panel of the superstructure body; and positioning bars to enable securement of the draft hood assembly to the top panel of the firebox.

(iii) Other Features of the Invention

By a feature of the draft hood assembly of this invention, the base plate has a rear edge which is provided with a transverse, rearwardly- and downwardly-projecting flange, such flange being adapted to engage a rear edge of the top panel, e.g., a downward flange thereof, of the firebox to assure positive aligned securement.

By another feature of the draft hood assembly of this invention, the upper exhaust opening in the top plate is provided with a hollow flue collar to facilitate mounting within the flue pipe. By a variant of this feature, such flue collar preferably includes an internal, sloping air guideway extending diametrically across the interior of the hollow, which preferably slopes at an angle between about 5° and about 20° i.e., about 10°.

By yet other features of the draft hood assembly of this invention, upper front plate is arcuate, in plan view; or the upper front plate is arcuate in plan view wherein the upper front plate is arcuate in plan view, and wherein the upper front plate is enclosed within a rectangular, parallelepiped box enclosure having a front facade wall, a pair of side walls perpendicularly-connected thereto, a lower wall perpendicularly-connected to the front facade wall and to the side walls, the lower wall including a rear arcuate cutout, and an upper wall perpendicularly-connected to the front facade wall and to the side walls.

By a still further feature of the draft hood assembly of this invention, the longitudinally-curved deflector is of less width than the width of the draft hood assembly.

By still another feature of the combination of the gas fireplace insert and the draft hood assembly includes a forward positioning clip on the top plate of the firebox.

By another feature of such combination, the longitudinally-extending, rearwardly- and downwardly-projecting flange on the rear edge of the base plate is in engagement with the rear edge of the upper panel of the firebox.

(iv) Generalized Description of the Invention

The draft hood assembly of this invention is a component of the gas fireplace. Its purpose is to minimize the potential of venting polluting flue products into the home. In the event of a down draft, the down draft is deflected into the room air space instead of into the firebox, where it could otherwise affect the flame and the clean combustion, and dump high levels of carbon monoxide into the room.

By another feature of such combination, the longitudinally-extending, rearwardly- and downwardly-projecting flange on the rear edge of the base plate is in engagement with the rear edge of the upper panel of the firebox; and the combination includes positioning strips on the base plate, the positioning strips being provided with downwardly-extending flanges in engagement with a forward edge of the upper panel of the firebox insert.

By a feature of the method of this invention, the top plate of the fireplace insert includes a forward guide clip and two lateral guide clips and the method includes the step of drawing the draft hood assembly forwardly until the front and side edges of the base of the draft hood engage respective ones of the guide clips.

BRIEF DESCRIPTION OF THE DRAWINGS

In the accompanying drawings.

Figure 1:
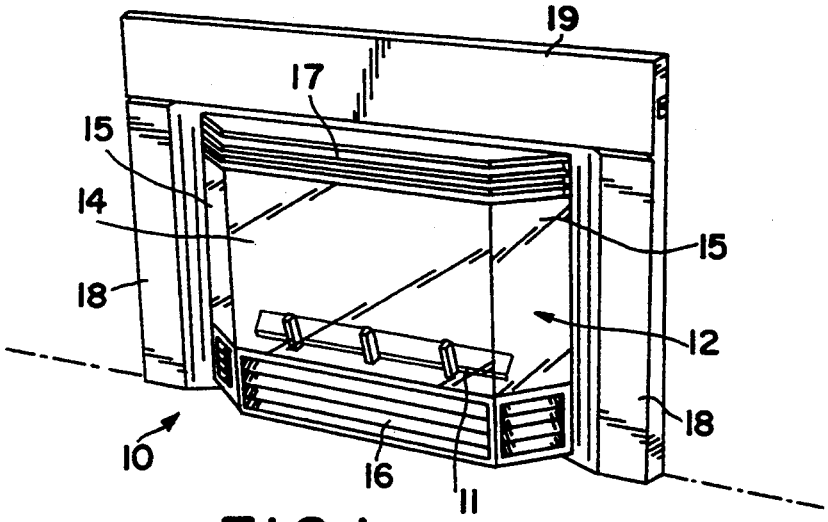
FIG. 1 is a perspective view of a gas fireplace insert including the draft hood assembly of this invention installed in a fireplace.

DESCRIPTION OF PREFERRED EMBODIMENTS (i) Description of FIG. 1

As seen in FIG. 1, the gas fireplace insert 10 is installed as a zero clearance fireplace insert. It includes a gas burner 11 within a firebox 12 and has a forwardly projecting transparent glass plate 13 having a flat front face 14 and two lateral, outwardly-angularly projecting sides 15. The base of the fireplace insert 10 is formed as a plurality of parallel overlapped louvres 16. The upper projecting face of the fireplace insert 10 is formed as a plurality of vertically-spaced-apart flat plates 17. The insert is provided with a pair of lateral faceplates 18 and an upper mantel 19.

Figure 2:
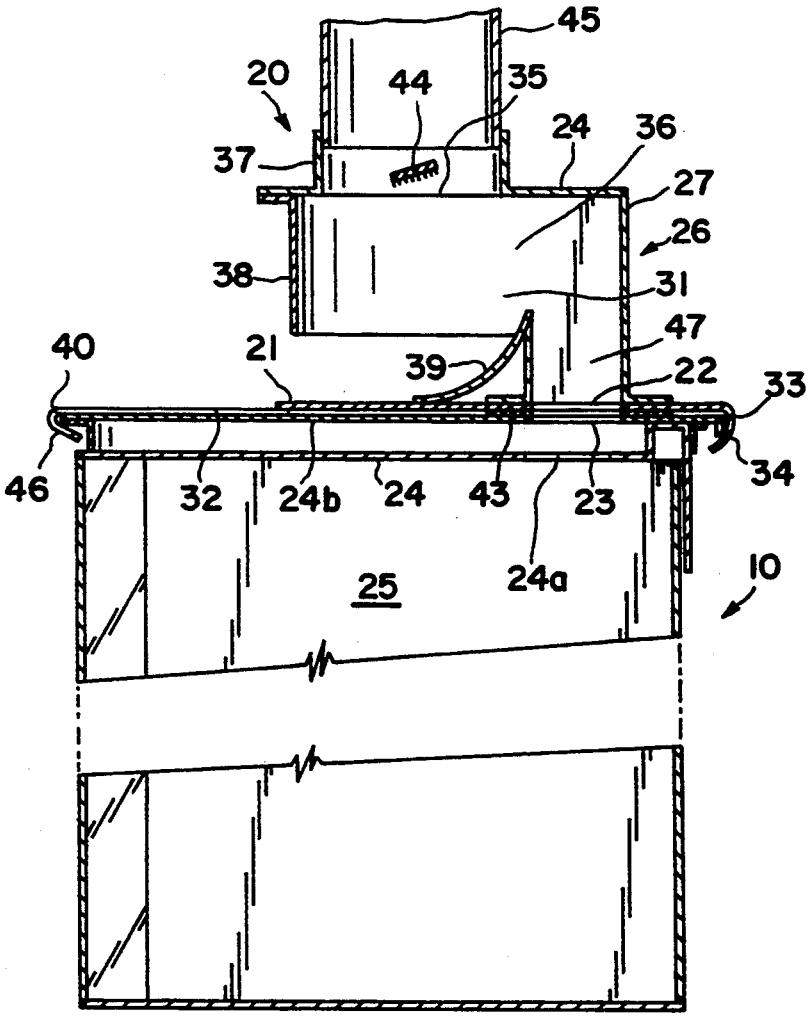
FIG. 2 is a central longitudinal cross-section showing the draft hood assembly of one embodiment of this invention assembled between the top of the firebox top panel of the fireplace insert and the bottom of the fireplace chimney flue pipe.
Figure 3:
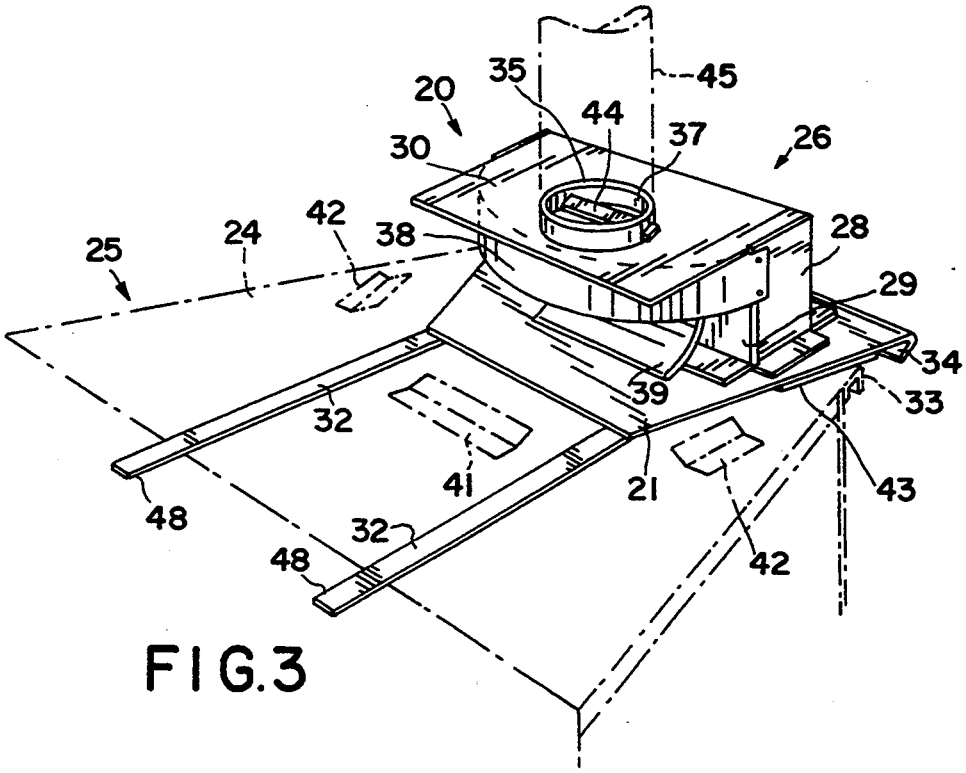
FIG. 3 is an isometric view of the draft hood assembly of FIG. 2 as installed.
Figure 4:
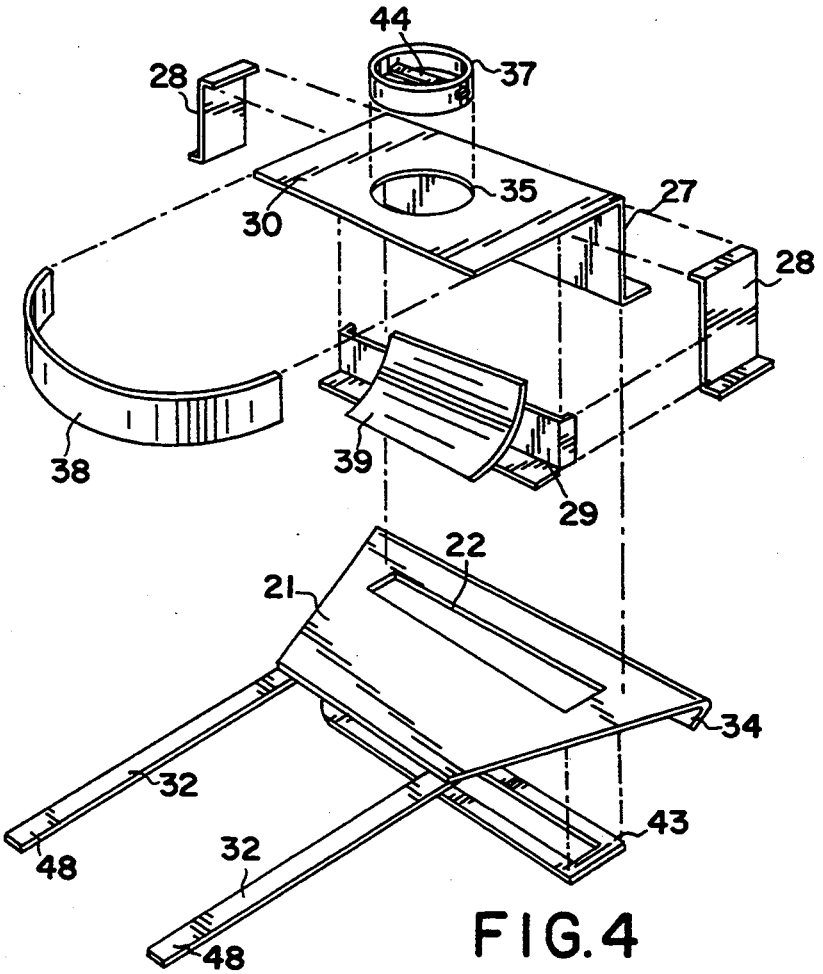
FIG. 4 is an exploded isometric view of the draft hood assembly of FIG. 2.

(ii) Description of FIGS. 2 to 4

As seen in FIGS. 2 to 4 of the drawings, the fireplace insert 10 includes a firebox 25 provided as a hollow, rectangular, parallelepiped consisting of six mutually-perpendicularly-interconnected panels, namely a bottom panel, a front panel, a rear panel, a pair of side panels and a top panel 24. Top panel 24 is provided with an exhaust vent opening 24*a*. Superposed atop such panel 24 is an exhaust channel defined at its bottom by top panel 24 and at its top by upper panel 24*b*, as well as by front and rear plates. Upper panel 24*b* is provided with exhaust opening 23, shown as being aligned with exhaust vent opening 24*a*. The hood assembly 20 includes a trapezoidal (in plan view) base plate 21 which diverges from front to rear. The base plate 21 is provided with an exhaust opening 22 which can be of any shape but which, in this example, is a generally-rectangular exhaust opening 22 which is alignable with a similarly-shaped exhaust opening 23 of the upper panel 24*b* and exhaust vent opening 24*a* of top plate 24 of the firebox 25 of the fireplace insert 10. On the lower face of base plate 21 surrounding the opening 22 is a sealing, heat-resistant gasket 43. The rear edge of the top plate 24 is provided with a transverse, downwardly-extending lip 33. Superimposed atop the base plate 21 is an integral superstructure body 26 including a full height rear plate 27, a pair of full height lateral plates 28, a partial height forward plate 29 and an upper, generally-rectangular plate 30. These plates define, between them, a lower exhaust chamber 46 leads to a main exhaust channel 31. Also secured to the base plate are a pair of spaced-apart, longitudinally-extending, positioning strips 32. The rear edge of the base plate 21 is provided with a transverse, downwardly and forwardly-extending flange 34, to engage lip 33 of the top plate 24 in a manner to be described hereinafter.

The upper plate 30 of the superstructure body 26 is provided with an exhaust hole 35 which is forwardly and completely offset from the upper portion 36 of the main exhaust channel 31. The exhaust hole 35 is provided with a flue collar 37. Flue collar 37 is provided with an air guideway 44 which slopes at an angle of about 5° to about 20°, e.g., about 10°. The air guideway 44 guides exhaust gas up the chimney and guides any downward draft from the chimney forwardly flue 45 is connected to, and extends upwardly from, the flue collar 43.

Projecting downwardly from the upper plate 30 is an arcuate-in-plan forward deflector 38 which terminates a fixed distance above the base plate 21. A longitudinally-curved rear deflector 39, of less width than the width of the draft hood 20 extends in front of the forward partial height plate 29 from the base plate 21 but terminates a fixed distance below the upper plate 30.

The top plate 24 of the firebox 25 is provided with a forward guide clip 41 and a pair of lateral guide clips 42.

Figure 5:
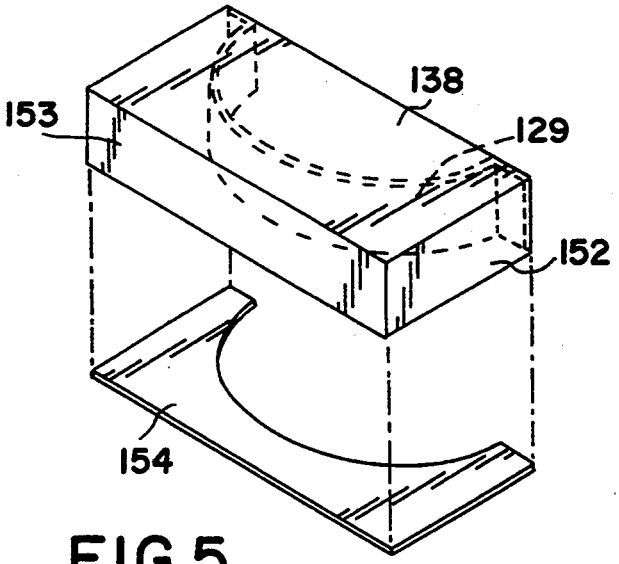
FIG. 5 is an exploded isometric view of a draft hood assembly; and a second embodiment of a superstructure providing a second embodiment of this invention.
Figure 6:
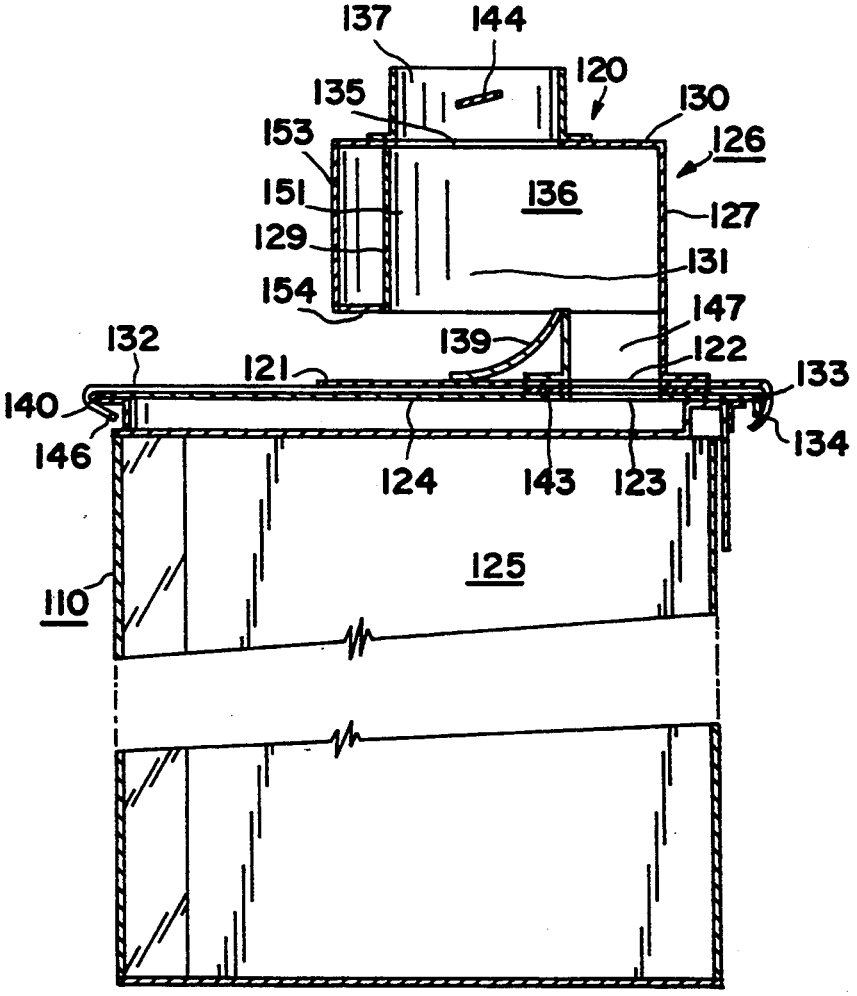
FIG. 6 is a central longitudinal cross-section showing the draft hood assembly of the second embodiment of this invention assembled between the top of the firebox top panel of the fireplace insert and the bottom of the fireplace chimney flue pipe.

(iii) Description of Embodiment of FIGS. 5 and 6

As seen in FIGS. 5 and 6 of the drawings, the draft hood assembly 120 includes a trapezoidal (in plan view) base plate 121 which diverges from front to rear. The base plate 121 is provided with an exhaust opening 122 which in this embodiment is a generally-rectangular exhaust opening 122 which is alignable with the similarly-shaped exhaust opening 123 of the top plate 124 of the firebox 125 of the fireplace insert 110. On the lower face of base plate 121 surrounding the opening 122 is a sealing, heat resistant gasket 143. The rear edge 133 of the top plate 124 is provided with a transverse, downwardly-extending lip 133. Superimposed atop the base plate 121 is an integral superstructure body 126 including a full height rear plate 127, a pair of full height lateral plates (not seen), a partial height forward plate 129 and an upper, generally-rectangular plate 130. These plates define, between them, an enclosed exhaust channel 131. Also secured to the base plate are a pair of spaced-apart, longitudinally-extending, positioning strips 132. The rear edge of the base plate 121 is provided with a transverse, downwardly and forwardly-extending flange 134, to engage lip 133 of the top plate 124 in a manner to be described hereinafter.

The upper plate 130 of the superstructure body 126 is provided with an exhaust hole 135 which is forwardly and completely offset from the upper portion 136 of the rear exhaust channel 131. The exhaust hole 135 is provided with a flue collar 137. The flue collar 137 is provided with an air guideway 144 which slopes at an angle of about 5° to about 20°, e.g., about 10°. The air guideway guides exhaust gas up the chimney and guides any downward draft from the chimney forwardly.

Projecting downwardly from the upper plate 130 is a box enclosure 151 provided by side plates 152 a forward plate 153 and a lower plate 154. Within the box enclosure 151 is an interior arcuate-in-plan forward deflector 138, the box enclosure 151 and the deflector 138 terminating a fixed distance above the base plate 121. A longitudinally-curved rear deflector 139, of less width than the width of the draft hood 120 extends in front of the forward partial height plate 129 from the base plate 121 but terminates a fixed distance below the upper plate 130.

The top plate 124 of the firebox 125 is provided with a forward guide clip (not seen, but similar to forward guide clip 41—see FIG. 3) and a pair of lateral guide clips (not seen, but similar to guide clips 42—see FIG. 3).

DESCRIPTION OF OPERATION OF THE INVENTION (i) Description of Embodiment of FIGS. 1 to 4

In installing the draft hood assembly 20, the flue collar 37 is inserted into, and secured by, the fireplace chimney flue 45 and literally hangs thereby. The fireplace insert 10 is then slid into place below the hanging draft hood assembly 20 until the positioning strips 32 are exposed beyond the front edge 40 of the top plate 24 of the firebox 25. The positioning strips are then suitably gripped and the draft hood 20 is pulled forwardly, with the downward flange 34 engaging the lip 33 of the top plate 24. The draft hood 20 is then positively urged forwardly until the edges of the base plate 21 are engaged with the forward guide clip 41, and with the lateral guide clips 42, and so that the respective exhaust apertures 22,23 are aligned. The downward flange 34 is firmly secured and locked to the lip 33.

Once the draft hood 20 is in position, the forward ends (not seen) 48 of the positioning strips 32 are bent down, cut off and folded under the front edge 40 of the top plate 24 of the firebox 25 of the fireplace insert 10 as shown at 46.

Although not shown, the draft hood 20 may be provided with the conventional microswitch to cooperate with a microswitch in the top plate 24 to provide positive assurance that the respective exhaust apertures 22,23 are properly aligned and that the draft hood 20 is sealed in an airtight manner to the top plate 24. In addition, a conventional thermal switch may be provided adjacent to the draft hood 20 to detect leakage of hot gas therefrom.

(ii) Description of Embodiment of FIGS. 5 to 7

In installing the draft hood assembly 120, the flue collar 137 is inserted into, and secured by, the fireplace chimney flue (not shown) and literally hangs thereby. The fireplace insert 110 is then slid into place below the hanging draft hood assembly 120 until the positioning strips 132 are exposed beyond the front edge 140 of the top plate 124 of the fireplace insert 110. The positioning strips 132 are then suitably gripped and the draft hood 120 is pulled forwardly, with the downward flange 134 engaging the rear edge 133 of the top plate 124. The draft hood 120 is then positively urged forwardly until the edges of the base plate 121 are engaged with the forward guide (not seen), and with the lateral guide clips (not seen), so that the respective exhaust apertures 122,123 are aligned. The downward flange 134 is firmly secured and locked to the lip 133

Once the draft hood 120 is in position, the forward ends 144 of the positioning strips 132 are bent down, cut off and folded under the front edge of the top plate 124 of the fireplace insert 110 as shown at 146.

Although not shown, the draft hood 120 may be provided with the conventional microswitch to cooperate with a microswitch in the top plate 124 to provide positive assurance that the respective exhaust apertures 122,123 are properly aligned and that the draft hood 120 is sealed in an airtight manner to the top p].ate 124. In addition, a conventional thermal switch may be provided adjacent to the draft hood 120 to detect leakage of hot gas therefrom.

CONCLUSION

Thus, the present invention minimizes the potential of venting polluting flue products into the home. In the event of a down draft, the down draft is deflected into the room air space instead of into the firebox, where it could otherwise affect the flame and the clean combustion, and dump high levels of carbon monoxide into the room.

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

We claim:

1. A draft hood assembly for connection between a gas fireplace insert and a chimney flue pipe, said gas fireplace insert consisting of a hollow, rectangular parallelepiped firebox consisting of six mutually-perpendicularly-interconnected panels, said panels comprising a top panel, a front panel, a rear panel, a bottom panel and a pair of side panels, said top panel including an exhaust vent opening therein, an exhaust channel superposed on said top panel, said exhaust channel being bounded by said top panel, said upper panel and said front and rear members, said upper panel including an exhaust opening therein, and a transversely-extending, rear edge; said draft hood comprising:

(i) a base plate, said base plate having an aperture therein, said aperture being alignable with said exhaust opening which is provided in said upper panel of said exhaust channel of said fireplace insert;

(ii) a hollow superstructure body integrally-mounted on said base plate, said superstructure body comprising a rear plate, a pair of side plates perpendicularly-connected thereto, a lower front plate perpendicularly-connected to each of said side plates, a bottom plate perpendicularly-connected to said lower front plate, to said side plates and to said rear plate, said bottom plate delineating an aperture alignable with said aperture in said base plate, an upper front plate perpendicularly-connected to said side plates, said upper front plate terminating a spaced-distance above said base plate, and a top plate perpendicularly-connected to said rear plate, to said side plates and to said upper front plate, said hollow superstructure body also including a lower, rear exhaust chamber defined by said rear plate, said side plates and said lower front plate, said lower, rear exhaust chamber thereby being in gaseous communication with said firebox, and an upper, front exhaust chamber which is in gaseous communication with said lower, rear exhaust chamber, said upper, front exhaust chamber being defined by said top plate, said side plates, said upper, front wall and by an open bottom face;

(iii) an upper exhaust opening in said top plate of said superstructure body, said upper exhaust opening leading from said upper, front exhaust chamber of said superstructure to said chimney flue pipe, said upper exhaust opening being situated forward of, but being completely forwardly offset from, and also being in gaseous communication with, said lower rear exhaust chamber;

(iv) a longitudinally-curved deflector secured to said lower front plate, said longitudinally-curved deflector extending upwardly from said base plate and terminating a spaced-distance below said top panel of said superstructure body; and (v) positioning bars to enable securement of said draft hood assembly to said top panel of said firebox.

2. The draft hood assembly of claim 1 wherein said base plate has a rear edge which is provided with a transverse, rearwardly and downwardly projecting flange, said flange being adapted to engage said transversely-extending rear edge of said upper panel of said firebox to assure positive aligned securement.

3. The draft hood assembly of claim 1 wherein said upper exhaust opening in said top plate is provided with a hollow flue collar to facilitate mounting within said flue pipe.

4. The draft hood assembly of claim 3 wherein said hollow flue collar includes an internal, sloping air guideway extending diametrically across the interior of said hollow flue collar.

5. The draft hood assembly of claim 4 wherein said air guideway slopes downwardly at an angle of about 5° to about 20°.

6. The draft hood assembly of claim 1 wherein said air guideway slopes downwardly at an angle of about 10°.

7. The draft hood assembly of claim 1 wherein said upper front plate is arcuate in plan view.

8. The draft hood assembly of claim 1 wherein said upper front plate is arcuate in plan view, and wherein said upper front plate is enclosed within a rectangular, parallelepiped box enclosure having a front facade wall, a pair of side walls perpendicularly-connected thereto, a lower wall perpendicularly-connected to said front facade wall and to said side walls, said lower wall including a rear arcuate cutout, and an upper wall perpendicularly-connected to said front facade wall and to said side walls.

9. The draft hood assembly of claim 1 wherein said longitudinally-curved deflector is of less width than the width of said draft hood assembly.

10. The combination of:

(A) a gas fireplace insert consisting of a hollow, rectangular parallelepiped firebox consisting of six mutually-perpendicularly-interconnected panels, said panels comprising a top panel, a front panel, a rear panel, a bottom panel and a pair of side panels, said upper panel having a lip depending from its rear edge and having a forward positioning clip and a pair of lateral positioning clips thereon; and (B) a draft hood assembly comprising:

(i) a base plate, said base plate having an aperture therein, said aperture being alignable with said exhaust opening which is provided in said upper panel of said exhaust channel of said fireplace insert;

(ii) a hollow superstructure body integrally-mounted on said base plate, said superstructure body comprising a rear plate, a pair of side plates perpendicularly-connected thereto, a lower front plate perpendicularly-connected to each of said side plates, a bottom plate perpendicularly-connected to said lower front plate, to said side plates and to said rear plate, said bottom plate delineating an aperture alignable with said aperture in said base plate, an upper front plate perpendicularly-connected to said side plates, said upper front plate terminating a spaced-distance above said base plate, and a top plate perpendicularly-connected to said rear plate, to said side plates and to said upper front plate, said hollow superstructure body also including a lower, rear exhaust chamber defined by said rear plate, said side plates and said lower front plate, said lower, rear exhaust chamber thereby being in gaseous communication with said firebox, and an upper, front exhaust chamber which is in gaseous communication with said lower, rear exhaust chamber, said upper, front exhaust chamber being defined by said top plate, said side plates, said upper, front wall and by an open bottom face;

(iii) an upper exhaust opening in said top plate of said superstructure body, said upper exhaust opening leading from said upper, front exhaust chamber of said superstructure to said chimney flue pipe, said upper exhaust opening being situated forward of, but being completely forwardly offset from, and also being in gaseous communication with, said lower rear exhaust chamber;

(iv) a longitudinally-curved deflector secured to said lower forward plate, said longitudinally-curved deflector extending upwardly from said base plate and terminating a spaced-distance below said top panel of said superstructure body; and (v) positioning bars to enable securement of said draft hood assembly to said top panel of said firebox.

11. The combination of claim 10 wherein a front edge of said base plate is in engagement with said forward positioning clip on said upper panel of said firebox.

12. The combination of claim 10 and wherein said longitudinally-extending, rearwardly and downwardly-projecting flange on said rear edge of said base plate is an engagement with said rear edge of said upper panel of said firebox.

13. The combination of claim 12, and wherein said longitudinally-extending, rearwardly and downwardly-projecting flange on said rear edge of said base plate is in engagement with said rear edge of said upper panel of said firebox; and including positioning strips on said base plate, said positioning strips being provided with downwardly-extending flanges in engagement with a forward edge of the upper panel of said firebox insert.

14. A method of installing a gas fireplace insert into a fireplace which has a flue pipe therein, said method comprising:

1) providing a gas fireplace insert consisting of a hollow, rectangular parallelepiped firebox consisting of six mutually-perpendicularly-interconnected panels, said panels comprising a top panel, a front panel, a rear panel, a bottom panel and a pair of side panels, said upper panel having a lip depending from its rear edge and having a forward positioning clip and a pair of lateral positioning clips thereon;

2) providing a draft hood assembly comprising: a base plate, said base plate having an aperture therein, said aperture being alignable with said exhaust opening which is provided in said upper panel of said exhaust channel of said fireplace insert; a hollow superstructure body integrally-mounted on said base plate, said superstructure body comprising a rear plate, a pair of side plates perpendicularly-connected thereto, a lower front plate perpendicularly-connected to each of said side plates, a bottom plate perpendicularly-connected to said lower front plate, to said side plates and to said rear plate, said bottom plate delineating an aperture alignable with said aperture in said base plate, an upper front plate perpendicularly-connected to said side plates, said upper front plate terminating a spaced-distance above said base plate, and a top plate perpendicularly-connected to said rear plate, to said side plates and to said upper front plate, said hollow superstructure body also including a lower, rear exhaust chamber defined by said rear plate, said side plates and said lower front plate, said lower, rear exhaust chamber thereby being in gaseous communication with said firebox, and an upper, front exhaust chamber which is in gaseous communication with said lower, rear exhaust chamber, said upper, front exhaust chamber being defined by said top plate, said side plates, said upper, front wall and by an open bottom face; an upper exhaust opening in said top plate of said superstructure body, said upper exhaust opening leading from said upper, front exhaust chamber of said superstructure to said chimney flue pipe, said upper exhaust opening being situated forward of, but being completely forwardly offset from, and also being in gaseous communication with, said lower rear exhaust chamber; and a longitudinally-curved deflector secured to said lower forward plate, said longitudinally-curved deflector extending upwardly from said base plate and terminating a spaced-distance below said top panel of said superstructure body;

3) providing positioning bars on said base plate to enable securement of said draft hood assembly to said upper panel of said firebox;

4) securing said flue collar which has previously been secured to said top plate of said superstructure of draft hood assembly to said flue pipe of said fireplace;

5) sliding said gas fireplace insert into said fireplace until said positioning bars of said draft hood extend beyond said front edge of said upper panel of said fireplace insert;

6) moving a transverse downward-extending rear flange of said base plate of said draft hood assembly into contact with the rear edge of said upper panel of said firebox, whereby said transverse, downwardly-extending rear flange of said base plate of said draft hood assembly is in engagement with said rear edge of said top panel of said firebox;

7) drawing said draft hood assembly forwardly to its maximum extent; and 8) bending down forward portions of said positioning bars against said front edge of said draft hood assembly, and then folding said bent down portions under said front edge of said top panel of said draft hood assembly, thereby providing a locking flange.

15. The method of claim 14 wherein said top plate of said fireplace insert includes a forward guide clip and two lateral guide clips, and including the step of drawing said draft hood assembly forwardly until the front and side edges of said base of said draft hood engage respective said guide clips.

* * * * *

UNITED STATES PATENT AND TRADEMARK OFFICE

CERTIFICATE OF CORRECTION

PATENT NO. : 5,419,307

DATED : May 30, 1995

INVENTOR(S) : Dave Linkletter, et al

It is certified that error appears in the above-indentified patent and that said Letters Patent is hereby corrected as shown below:

In column 4, line 45, delete "draft hood assembly as described above; securing the".

In column 5, after line 68, insert

--By another feature of such combination, the longitudinally-extending, rearwardly- and downwardly-projecting flange on the rear edge of the base plate is in engagement with the rear edge of the upper panel of the firebox; and the combination includes positioning strips on the base plate, the positioning strips being provided with downwardly-extending flanges in engagement with a forward edge of the upper panel of the firebox insert.

By a feature of the method of this invention, the top plate of the fireplace insert includes a forward guide clip and two lateral guide clips and the method includes the step of drawing the draft hood assembly forwardly until the front and side edges of the base of the draft hood engage respective ones of the guide clips.

In column 6, delete from line 11 "By another..." to line 25 "...guide clips."

Column 7, line 42, delete "forwardly flue" and insert therefor --forwardly. A flue--..

Column 8, line 21, delete "152 a" and insert therefor --152, a--.

Column 9, line 28, delete "p],ate" and insert therefor --plate--.

UNITED STATES PATENT AND TRADEMARK OFFICE

CERTIFICATE OF CORRECTION

PATENT NO. : 5,419,307

DATED : May 30, 1995

INVENTOR(S) : Dave Linkletter ,et al

It is certified that error appears in the above-indentified patent and that said Letters Patent is hereby corrected as shown below:

Claim 4, Column 10, line 51, after the word "sloping", insert —,—.

Claim 6, Column 10, line 57, delete "claim 1" and insert therefor — claim 5—.

Claim 13, Column 12, line 3, delete "claim 12" and insert therefor — claim 10—.

Signed and Sealed this

Nineteenth Day of December, 1995

Bruce Lehman

*Attest:*

BRUCE LEHMAN

*Attesting Officer*

*Commissioner of Patents and Trademarks*